United States Patent [19]

Jaster

[11] Patent Number: 4,918,942

[45] Date of Patent: Apr. 24, 1990

[54] REFRIGERATION SYSTEM WITH DUAL EVAPORATORS AND SUCTION LINE HEATING

[75] Inventor: Heinz Jaster, Schenectady, N.Y.

[73] Assignee: General Electric Company, Schenectady, N.Y.

[21] Appl. No.: 419,982

[22] Filed: Oct. 11, 1989

[51] Int. Cl.[5] ..... F25B 7/00

[52] U.S. Cl. ..... 62/335; 62/510; 62/513

[58] Field of Search ..... 62/335, 510, 513, 113

[56] References Cited

U.S. PATENT DOCUMENTS

| | | | |
|---|---|---|---|
| 2,500,688 | 3/1950 | Kellie | 62/115 |
| 2,667,756 | 10/1989 | Atchison | 62/3 |
| 3,360,958 | 1/1968 | Miner | 62/470 |
| 3,848,422 | 11/1974 | Schibbye | 62/84 |
| 3,851,494 | 12/1974 | Hess | 62/513 |
| 3,952,533 | 4/1976 | Johnston et al. | 62/513 |
| 4,393,661 | 7/1983 | Vakil | 62/513 |
| 4,420,946 | 12/1983 | Rojey et al. | 62/513 |
| 4,439,998 | 4/1984 | Horvay et al. | 62/199 |
| 4,745,777 | 5/1988 | Morishita et al. | 62/509 |

FOREIGN PATENT DOCUMENTS

| | | |
|---|---|---|
| 431893 | 11/1911 | France . |
| 1134858 | 1/1985 | U.S.S.R. . |

OTHER PUBLICATIONS

"Refrigeration and Air Conditioning", W. F. Stoecker, 1958, Mc Graw Hill, pp. 57-61.

"Heat Pumps-Limitations and Potential", J. B. Comly, H. Jaster, J. P. Quaile, Technical Information Series, Sep. 1975, pp. 7, 8, and 18.

"Principles of Refrigeration", Roy J. Dossat, 2nd ed., John Wiley & Sons, Inc., 1976, pp. 240, 241, 430, 536.

*Primary Examiner*—Ronald C. Capossela

*Attorney, Agent, or Firm*—William H. Steinberg; James C. Davis, Jr.; Paul R. Webb, II

[57] ABSTRACT

A refrigeration system suitable for use in a household refrigerator having a freezer compartment and a fresh food compartment is provided. The refrigeration system includes a first capillary tube, a first evaporator for providing cooling to the freezer compartment, a two stage compressor, a condenser, a second capillary, and a second evaporator providing cooling to the fresh food compartment. All the above elements are connected together in series in that order, in a refrigerant flow relationship. A phase separator connects the second evaporator to the first capillary tube in a refrigerator flow relationship and the phase separator provides intercooling between the first and second compressors. A first fraction of the second capillary tube in a heat transfer relationship with the gaseous phase refrigerant providing intercooling and a second fraction of the second capillary tube in a heat transfer relationship with the gaseous phase refrigerant supplied to the suction inlet of the first stage of the compressor.

5 Claims, 4 Drawing Sheets

REFRIGERATION SYSTEM WITH DUAL EVAPORATORS AND SUCTION LINE HEATING

CROSS REFERENCE TO RELATED APPLICATIONS

The present application is related to copending application Ser. No. 07/351,988, entitled "Refrigerator System With Dual Evaporators for Household Refrigerators" which is a continuation of Ser. No. 07/288,848, now abandoned. The cross referenced application is assigned to the same assignee as the present invention.

BACKGROUND OF THE INVENTION

The present invention relates to household refrigerators operating with a vapor compression cycle and more particularly, to refrigerators with a two stage compressor and dual evaporators.

Currently produced household refrigerators operate on the simple vapor compression cycle. The prior art cycle shown in FIG. 1, includes a compressor A, condenser B, expansion valve C, evaporator D, and a two phase refrigerant. In the cycle shown, a capillary tube acts as a throttle. The capillary tube is placed in close proximity with the suction line of the compressor to cool the capillary tube. The subcooling which occurs to the refrigerant in the capillary tube increases the cooling capacity per unit mass flow rate in the system thereby increasing system efficiency which more than compensates for the disadvantage of increasing the temperature of the gas supplied to the compressor. The evaporator in FIG. 1 operates at approximately −10° F. Refrigerator air is blown across the evaporator and the air flow is controlled so that part of the air flow goes to the freezer compartment and the remainder of the flow goes to the fresh food compartment. The refrigerator cycle, therefore, produces its refrigeration effect at a temperature which is appropriate for the freezer, but lower than it needs to be for the fresh food compartment. Since the mechanical energy required to produce cooling at low temperatures is greater than it is at higher temperatures, the simple vapor compression cycle uses more mechanical energy than one which produces cooling at two temperature levels.

A well known procedure to reduce mechanical energy use is to operate two independent refrigeration cycles, one to serve the freezer at low temperatures and one to serve the fresh food compartment at an intermediate temperature. Such a system, however, is very costly.

Another problem which occurs in cooling for freezer operation in the simple vapor compression cycle, is the large temperature difference between the inlet and outlet temperatures of the compressor. The gas exiting the compressor is superheated, which represents a thermodynamic irreversibility which results in a relatively low thermodynamic efficiency. Lowering the amount of superheat will provide for decreased use of mechanical energy and therefore greater efficiency.

It is an object of the present invention to provide a refrigerator system for use in household refrigerators which has improved thermodynamic efficiency.

It is a further object of the present invention to provide a refrigerator system suitable for use in household refrigerators which reduces the gas temperature at the compressor discharge ports.

It is another object of the present invention to provide a refrigerator system which does not have moisture condensing from the air, on the compressor suction lines.

SUMMARY OF THE INVENTION

In one aspect of the present invention, a refrigeration system suitable for use in a household refrigerator having a freezer compartment and a fresh food compartment is provided. The refrigerator system includes a refrigerant flow control means, a first evaporator for providing cooling to the freezer compartment, a two stage compressor, a condenser, a capillary tube, and a second evaporator providing cooling to the fresh food compartment. All the above elements are connected together in series in that order by conduit means, in a refrigerant flow relationship. A phase separator has an inlet and two outlets, with the first outlet providing liquid phase refrigerant and the second outlet providing gaseous phase refrigerant. The inlet of the phase separator is connected to the second evaporator by the conduit means and the first outlet is connected to the refrigerant flow control means by the conduit means in a refrigerant flow relationship. The second outlet of the phase separator is connected between the first and second compressor stages. A first fraction of the capillary tube is in a heat transfer relationship with the conduit means connecting the phase separator between the first and second compressor stages. A second fraction of the capillary tube is in a heat transfer relationship with the conduit means connecting the first evaporator with the suction side of the first stage compressor.

BRIEF DESCRIPTION OF THE DRAWING

The subject matter which is regarded as the invention is particularly pointed out and distinctly claimed in the concluding portion of the specification. The invention, however, both as to organization and method of practice, together with further objects and advantages thereof, may best be understood by reference to the following description taken in conjunction with accompanying figures in which:

DETAILED DESCRIPTION OF THE INVENTION

Figure 2:
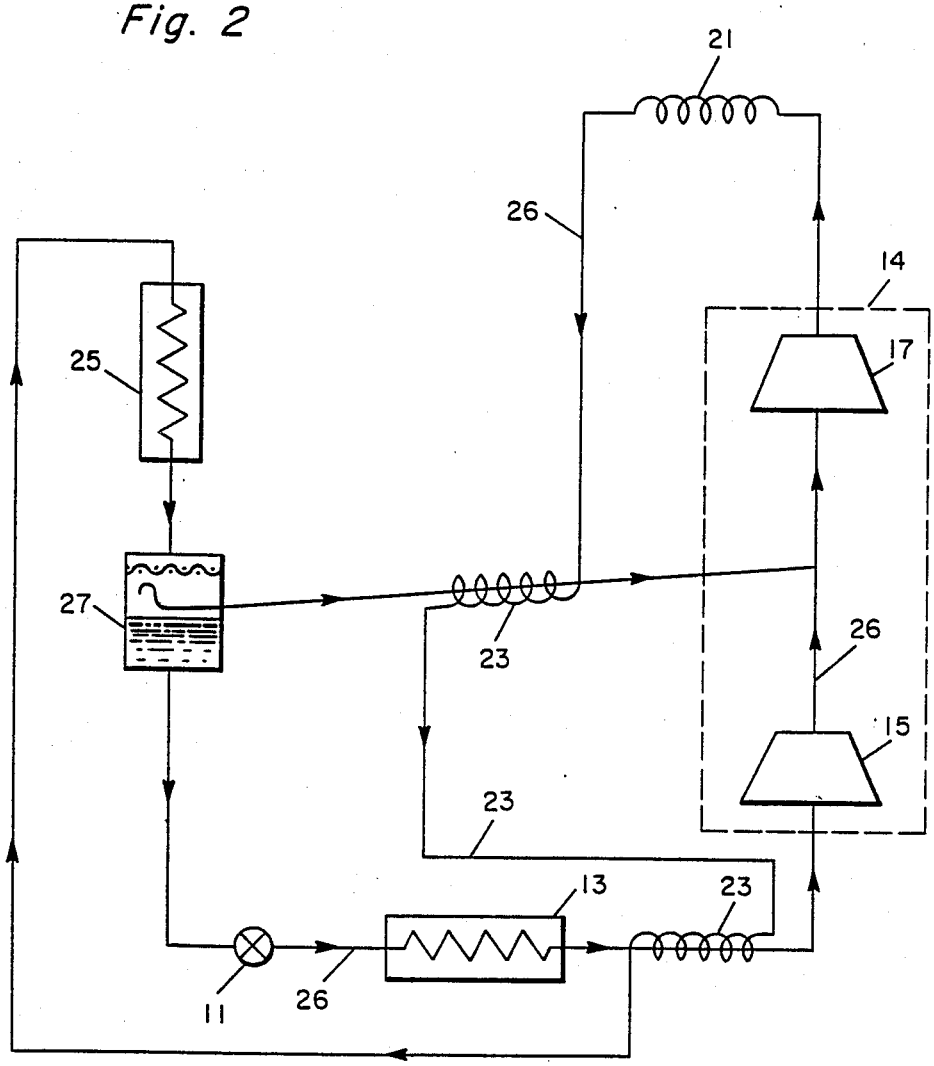
FIG. 2 is a schematic representation of one embodiment of a dual evaporator two-stage system in accordance with the present invention.
Figure 3:
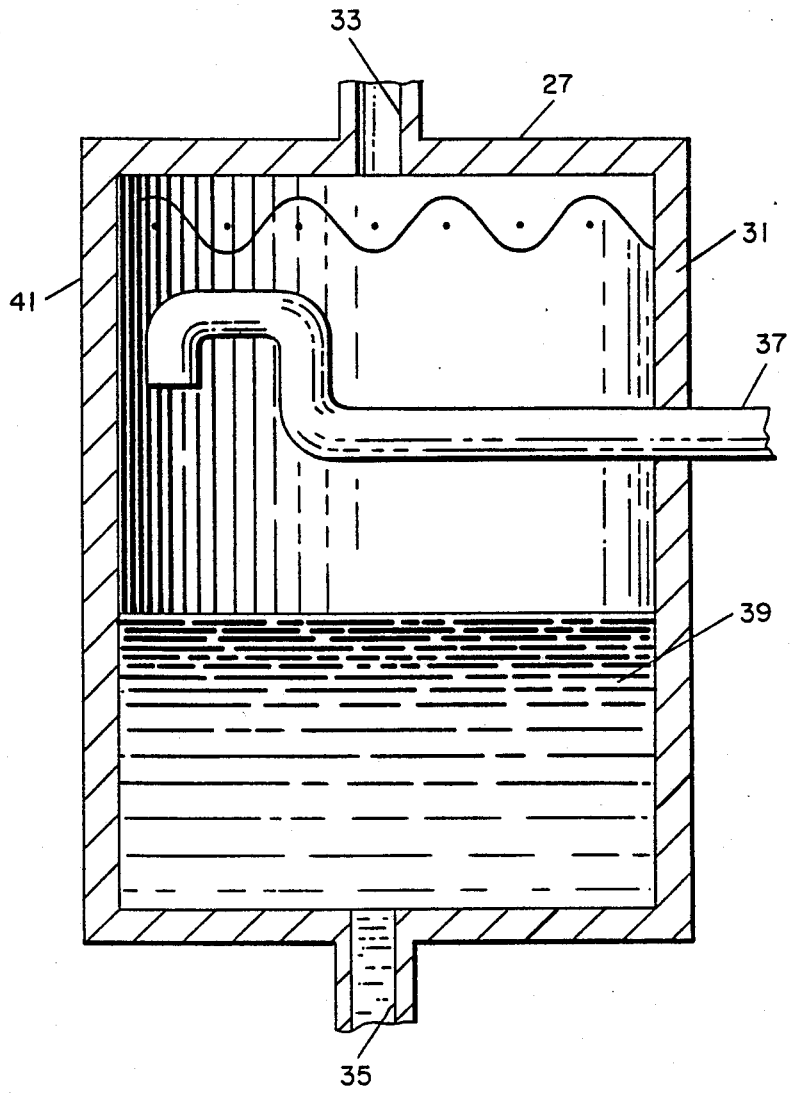
FIG. 3 is a sectional view of the phase separator of FIG. 2.

Referring now to the drawing and particularly FIG. 2 thereof, one embodiment of a dual evaporator two-stage system is shown. The system comprises a throttle to control refrigerant flow, shown as an expansion valve 11, a first evaporator 13, a two stage compressor 14 having a first and second stage 15 and 17, respectively, a condenser 21, a capillary tube 23, and a second evaporator 25, connected together in that order, in series, in a refrigerant flow relationship by conduit 26. A phase separator 27, shown in cross section in FIG. 3, comprises a closed receptacle 31 having an inlet 33 at its upper portion for admitting liquid and gaseous phase refrigerant and having two outlets 35 and 37. A screen 44 is located in the upper portion of the receptacle to remove any solid material carried along with the refrigerant when entering the inlet 33. The first outlet 35 is located at the bottom of the receptacle 31 and provides liquid refrigerant 39. The second outlet 37 is provided by a conduit which extends from the interior of the upper portion of the receptacle to the exterior. The conduit is in flow communication with the upper portion and is arranged so that liquid refrigerant entering the upper portion of the receptacle through inlet 33 cannot enter the open end of the conduit. Two phase refrigerant from the capillary tube is connected to the inlet 33 of the phase separator 27. The phase separator provides liquid refrigerant to the expansion valve 11. The phase separator also provides saturated refrigerant vapor which combines with vapor output by the first compressor 15 and together are connected to the inlet of the second compressor 17. The capillary tube 23 has a fraction of its length in thermal contact with the conduit which connects the phase separator with the junction of the outlet of the first compressor stage and the second compressor stage suction line. The remaining fraction of the capillary tube is in thermal contact with the first compressor stage suction line. Thermal contact can be achieved by soldering the exterior of the capillary tube and the exterior of the conduit together side by side. FIG. 2 shows the capillary tube wrapped around the conduit 26. This, however, is a schematic representation of a heat transfer relationship. The heat transfer occurs in a counterflow arrangement with the capillary tube flow proceeding in a direction opposite to the refrigerant conduit flow to maximize the heat exchange efficiency. The first and second compressor stages are preferably located in a single unit 14 driven by a single motor (not shown).

In operation, the first evaporator 13 contains refrigerant at a temperature of approximately −10° F. for cooling the freezer compartment. The second evaporator 25 contains the refrigerant at a temperature of approximately 25° F. for cooling the fresh food compartment.

The expansion valve 11 is adjusted to obtain just barely dry gas flow at the exit of evaporator 13, or a capillary tube having the appropriate bore size and length can alternatively be used. The gas entering the first compressor stage 15 from evaporator 13 is compressed. The gas discharged from the first compressor stage is mixed with gas at the saturation temperature from the phase separator 27 and the two gases are further compressed by the second compressor stage 17. The high temperature, high pressure discharge gas from the second compressor stage is condensed in condenser 21. The capillary tube 23 is sized to obtain some subcooling of the liquid exiting the condenser. The capillary tube is a fixed length of a small diameter tube. Because of the small diameter a high pressure drop occurs along the capillary tube length reducing the pressure of the liquid refrigerant below its saturation pressure causing it to change to a gas. The capillary tube meters the flow of refrigerant and maintains a pressure difference between the condenser and evaporator. The direct contact between the outside of the warm capillary tube into which the warm condensed liquid from the condenser enters and the outside of the saturated vapor line from the phase separator, causes the cooler vapor line to warm and the capillary tube to cool. Since the compressor suction line temperatures for the first and second stages in the present embodiments are approximately −10° F. and 25° F., without suction line heating from the capillary tube, moisture from the room temperature air, condensing on these lines causes parasitic heat gains to the refrigerant reducing efficiency. The condensing moisture also tends to drip creating a separate problem. Suction line heating by means of the capillary tube warms the suction lines sufficiently to avoid condensation and also cools the refrigerant in the capillary tube flowing to the evaporator. Warming of the refrigerant vapor in the suction lines has an adverse effect on efficiency but when combined with beneficial effect of the cooling of the refrigerant in the capillary tube, overall system efficiency increases. The expansion of the liquid refrigerant in the capillary tube causes part of the liquid to evaporate and cool the remainder to the second evaporator temperature. The liquid and gas phase refrigerant enters the phase separator 27. Liquid refrigerant accumulates in the lower portion of the receptacle and gas accumulates in the upper portion. The phase separator supplies the gas portion to be combined with the gas exiting the first stage compressor 15. The gas from the phase separator is at approximately 25° F. and cools the gas exiting from the first stage compressor, thereby lowering the gas temperature entering the second compressor 17 from what it would have otherwise have been without the intercooling. The liquid of the two phase mixture from the second evaporator 25 flows from the phase separator 27 through the first throttle 11 causing the refrigerant to a still lower pressure. The remaining liquid evaporates in the first evaporator 13 cooling the evaporator to approximately −10° F. A sufficient refrigerant charge is supplied to the system so that the desired liquid level can be maintained in the phase separator.

The pressure ratio of the two compressor stages is determined by the type of refrigerant used and the temperatures at which the evaporators are to operate. The pressure at the input to the first compressor 15 is determined by the pressure at which the refrigerant exists in two phase equilibrium at −10° F. The pressure at the output of the first compressor stage is determined by the saturation pressure of the refrigerant at 25° F. The temperature of the condenser 21 has to be greater than that of the ambient temperature in order to function as a heat exchanger under a wide range of operating conditions. If the condenser is to operate at 105° F., for example, then the pressure of the refrigerant at saturation can be determined. The volume displacement capability of the compressors are determined by the amount of cooling capacity the system requires at each of the two temperatures levels, which determines the mass flow rate of the refrigerant through the compressor stages.

The dual evaporator two-stage cycle requires less mechanical energy compared to a single evaporator single compressor cycle with the same cooling capacity. The efficiency advantages come about due to the fact that the gas leaving the higher temperature evaporator is compressed from an intermediate pressure, rather than from the lower pressure of the gas leaving the lower temperature evaporator. Also contributing to improved efficiency is the cooling of the gas exiting the first compressor by the addition of gas cooled to saturation temperature from the phase separator. The cooling of the gas entering the second compressor reduces the mechanical energy requirement of the second compressor.

Figure 4:
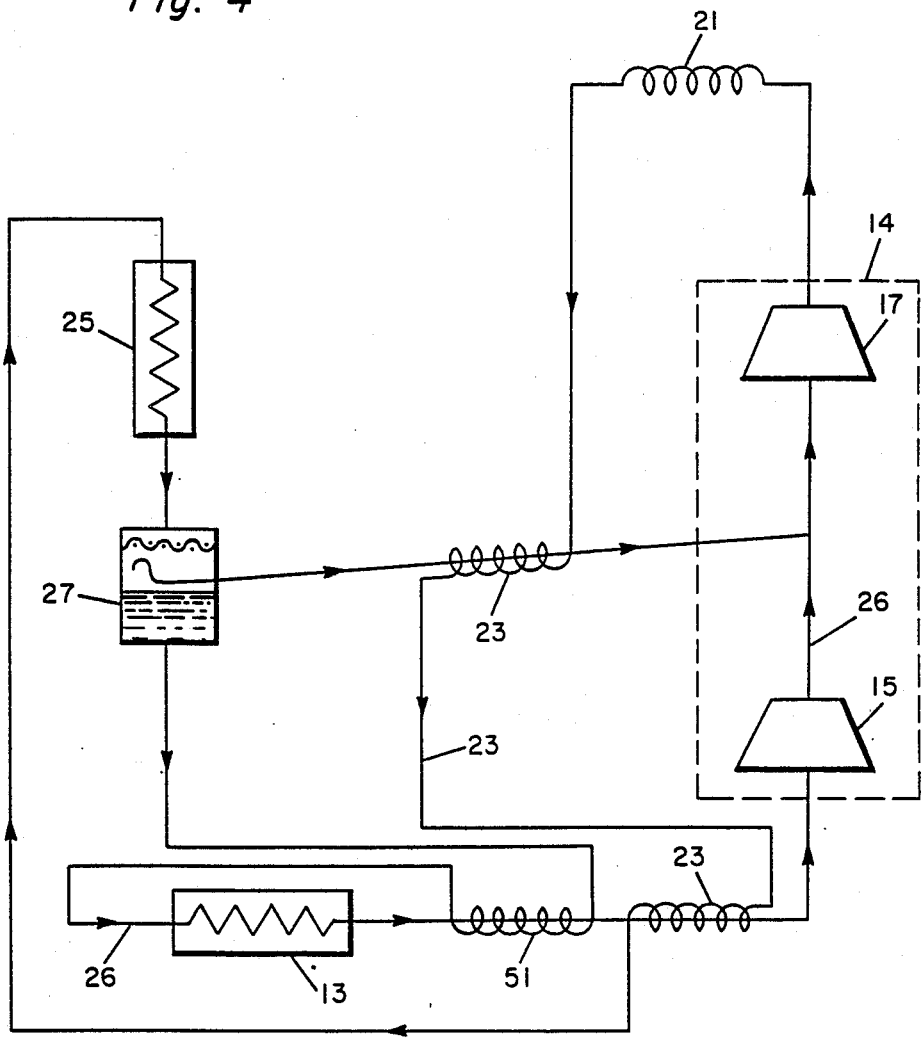
FIG. 4 is a schematic representation of another embodiment of a dual evaporator two-stage system in accordance with the present invention.

Another embodiment of the present invention is shown in FIG. 4. The system comprises the same components that are used in FIG. 2, interconnected in the same way except for a capillary tube 51 which is used in place of the expansion valve 11 in FIG. 2. The capillary tube 51 is connected in a refrigerant flow relationship between the liquid outlet port of the phase evaporator and the inlet to the first evaporator as in FIG. 2 but is also situated in a heat transfer relationship with the refrigerant line exiting the first evaporator 13. The capillary tube 51 is preferably soldered to the conduit exiting the first evaporator in a counterflow arrangement. Capillary tube 23 is soldered to the portion of the conduit exiting the first evaporator closer to inlet of the first compressor stage 15 than where the fractional portion of the capillary tube 51 is soldered.

In operation, a fraction of capillary tube 23 is cooled first by contact with the vapor line extending from the phase separator to the input of the second stage compressor. After cooling by contact with this vapor line the first capillary tube 23 is still warmer than the second capillary tube 51 before the second capillary tube contacts the outlet conduit from the first evaporator. Therefore the second capillary tube 51 contacts a portion of the conduit leading from the first evaporator to the inlet of the first compressor stage which has not been heated by the first capillary tube. If capillary tube 23 were to contact the portion of the conduit closest to the evaporator, the temperature of the conduit would be raised sufficiently to prevent cooling of capillary tube 51 by contact with the conduit. Capillary tube 51 causes the refrigerant supplied to the first evaporator to be cooler and the refrigerant supplied to the first stage compressor to be warmer than they would be if capillary tube 51 were not in a heat transfer relationship with the outlet of the first evaporator. The use of capillary tube 51 in a heat transfer relationship further increases the overall efficiency but not by an amount as great as the improvement introduced by suction line heating provided by capillary tube 23, since the temperature difference between the capillary tube 51 and the first stage compressor suction line is less than that between capillary tube 23 and the suction lines with which it is in contact.

When refrigerant R-12 is used the relative compressor sizes (displacements) in the two stage dual evaporator cycles of both FIGS. 2 and 4 of the first and second stage compressors are 0.27 and 0.45 compared to a compressor size of 1 for the simple vapor compression cycle, for the same overall refrigeration capacity.

In the embodiments of FIGS. 2 and 4 the compressors can be of the reciprocating type with hermetically sealed motors or of the rotary type with hermetically sealed motors or of any positive displacement type with hermetically sealed motors. The first compressor when refrigerant R-12 is used can be very small and operates against a pressure ratio of only 2, which could allow the use of, for example, an inexpensive diaphragm compressor. Improved efficiency can be achieved by operating both compressors from a single motor. Since a larger motor can be more efficient than two smaller motors providing the same total power.

Figure 1:
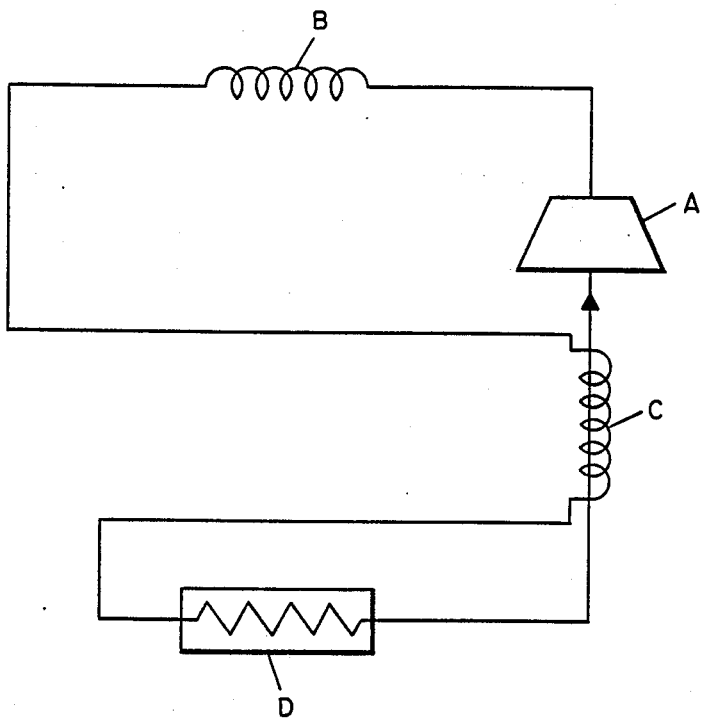
Fig. 1 (Prior Art)
FIG. 1 is a schematic representation of a prior art vapor compression system used in a household refrigerator.

Performance calculations for the cycles of FIG. 1 and FIG. 2 follow. All cycles are assumed to use R12 refrigerant and the total cooling capacity of each of the cycles was assumed to be 1000 Btu/hr. In addition, all cycles are assumed to use rotary compressors with hermetically sealed motors cooled by refrigerant at the discharge pressure of the compressor. For the prior art cycle of FIG. 1 the evaporator exit saturation temperature was assumed to be −10° F., and have a pressure drop of 1 psi and an exit superheat of 0°. The compressor adiabatic efficiency was assumed to be 0.61, motor efficiency 0.8 and additional heating of suction gas due to heat transfer from the compressor shell 43° F. The capillary tube heat transfer to the suction line of the compressor results in suction gas heating to 98° F. The condenser entrance saturation temperature is assumed to be 130° F., the pressure drop 10 psi, and exit subcooling 5° F.

Based on these parameters, the motor discharge temperature is calculated to be 429° F., refrigerant flow rate 18.6 lbm/hr, compressor power 270 Watts and the coefficient of performance 1.09.

For the cycle of FIG. 2 the first evaporator was assumed to have an exit saturation temperature of −10° F., with a pressure drop of 1 psi and an exit superheat of 0° F. The second evaporator is assumed to have an exit temperature of 25° F. and 0 psi pressure drop. The first and second compressor have an adiabatic efficiency of 0.7 and a motor efficiency of 0.8. The first compressor produces an additional superheating of suction gas due to heat transfer from the compressor shell of 5° F. The second compressor has an additional superheating of suction gas of 10° F. The condenser has an entrance saturation temperature of 130° F., a pressure drop of 10 psi and an exit subcooling of 5° F. The cooling capacity of 1000 Btu/hr is divided equally between the two evaporators.

The computed results from the above parameters for the cycle in FIG. 2 are a second compressor discharge gas temperature of 208° F. and a first stage compressor discharge gas temperature of 66° F. The compressor flow rates of the first and second compressors are 8.0 lbm/hr and 24.7 lbm/hr, respectively. The first and second compressor power consumptions are 22.2 and 164 watts, respectively. The coefficient of performance is 1.58. With first and second stage suction line heating with half the capillary tube length soldered to each of the compressor stages suction lines the first stage suction line temperature is calculated to be 57° F. and the second stage suction line temperature is calculated to be 94° F. The coefficient of performance is calculated to improve by 2.5% compared to the same cycle without suction line heating to a coefficient of performance of 1.62.

While the calculations were performed using a refrigerant containing chlorofluorocarbons, other types of refrigerant can be used, with similar advantages compared to presently used cycles.

The foregoing has described a refrigerator system with dual evaporators suitable for use with household refrigerators that has improved thermodynamic efficiency.

While the invention has been particularly shown and described with reference to several preferred embodiments thereof, it will be understood by those skilled in the art that various changes in form and detail may be made without departing from the spirit and scope of the invention.

What I claim is:

1. A refrigeration system using a two phase refrigerant for use in a refrigerator having a freezer compartment and a fresh food compartment, said refrigeration system comprising:

a refrigerant flow control means;

a first evaporator for providing cooling to the freezer compartment;

a two stage compressor;

a condenser;

a capillary tube;

a second evaporator for providing cooling to the fresh food compartment;

conduit means for connecting all the above elements together in series in the order listed, in a refrigerant flow relationship; and a phase separator having an inlet and two outlets, the first outlet for providing liquid phase refrigerant, the second outlet for providing gaseous phase refrigerant, said phase separator having its inlet connected to said second evaporator and its first outlet connected to the refrigerant flow control means by said conduit means, the second outlet of said phase separator connected between the first and second stages of said compressor, a first fraction of said capillary tube in a heat transfer relationship with the conduit means connecting said phase separator second outlet between the first and second stages of said compressor, a second fraction of said capillary tube in a heat transfer relationship with the conduit means connecting said first evaporator with the suction side of said first stage compressor.

2. The refrigeration system of claim 1 wherein said heat transfer relationship comprises a counterflow heat transfer relationship with the exterior of the capillary tube soldered to the exterior of said conduit means.

3. The refrigeration system of claim 1 wherein said refrigerant flow control means comprises a second capillary tube.

4. A refrigeration system using a two phase refrigerant for use in a refrigerator having a freezer compartment and a fresh food compartment, said refrigeration system comprising:

a first capillary tube;

a first evaporator for providing cooling to the freezer compartment;

a two stage compressor;

a condenser;

a second capillary tube;

a second evaporator for providing cooling to the fresh food compartment;

conduit means for connecting all the above elements together in series in the order listed, in a refrigerant flow relationship; and a phase separator having an inlet and two outlets, the first outlet for providing liquid phase refrigerant, the second outlet for providing gaseous phase refrigerant, said phase separator having its inlet connected to said second evaporator and its first outlet connected to the first capillary tube by said conduit means in a refrigerant flow relationship, the second outlet of said phase separator connected between the first and second stages of said compressor in a refrigerant flow relationship, a first fraction of said second capillary tube in a heat transfer relationship with the conduit means connecting the phase separator second outlet between the first and second stages of said compressor, a second fraction of said second capillary tube in a heat transfer relationship with the conduit means connecting said first evaporator with the suction side of the first stage of said compressor, said first capillary tube in a heat transfer relationship with a portion of the conduit means connecting said first evaporator with the suction side of said first stage compressor, said portion located between the first evaporator and where said second fraction of said second capillary tube is in a heat transfer relationship with the conduit means.

5. The refrigeration system of claim 4 wherein said heat transfer relationships comprise a counterflow heat transfer relationship with the exterior of the capillary tubes soldered to the exterior of said conduit means.

* * * * *